US006640535B2

(12) United States Patent
Gallimore et al.

(10) Patent No.: US 6,640,535 B2
(45) Date of Patent: Nov. 4, 2003

(54) LINEAR GRIDLESS ION THRUSTER

(75) Inventors: Alec D. Gallimore, Ann Arbor, MI (US); Brian Beal, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 0 days.

(21) Appl. No.: 10/170,970

(22) Filed: Jun. 13, 2002

(65) Prior Publication Data

US 2002/0194833 A1 Dec. 26, 2002

Related U.S. Application Data

(60) Provisional application No. 60/297,911, filed on Jun. 13, 2001.

(51) Int. Cl.[7] ..... F03H 1/00; H05H 1/11

(52) U.S. Cl. ..... 60/202; 313/362.1; 315/111.61

(58) Field of Search ..... 60/202; 313/361.1, 313/362.1; 315/111.41, 111.61

(56) References Cited

U.S. PATENT DOCUMENTS 3,505,550 A * 4/1970 Levoy et al. ..... 60/202
4,937,456 A * 6/1990 Grim et al. ..... 250/427
5,107,170 A * 4/1992 Ishikawa et al. ..... 313/362.1
5,859,428 A * 1/1999 Fruchtman ..... 315/111.41
5,973,447 A * 10/1999 Mahoney et al. ..... 313/359.1
6,158,209 A * 12/2000 Latischev et al. ..... 60/202
6,181,585 B1 1/2001 Cardwell, Jr.
6,215,124 B1 * 4/2001 King ..... 60/202
6,336,318 B1 * 1/2002 Falce et al. ..... 60/202
6,448,721 B2 * 9/2002 Raitses et al. ..... 315/501
6,449,941 B1 * 9/2002 Warboys et al. ..... 60/202

FOREIGN PATENT DOCUMENTS

WO WO 99 28624 6/1999

OTHER PUBLICATIONS

Garkusha, V.I., et al., "Anode Layer Thrusters, State–of–the Art and Perspectives," IEPC Paper 93–228, 23rd International Electric Propulsion Conference, Seattle, Wa, 1993.
Haas, J.M., Gulczinski III, F.S., and Gallimore, A.D., "Performance Characteristics of a 5 kW Laboratory Hall Thruster," AIAA Paper 97–3503, 34th Joint Propulsion Conference, Cleveland, OH, Jul. 1998.
International Search Report, PCT International Application No. PCT/US 02/19005.

(List continued on next page.)

*Primary Examiner*—Ted Kim
(74) *Attorney, Agent, or Firm*—Harness, Dickey & Pierce, PLC

(57) ABSTRACT

A linear gridless ion thruster (LGIT) is provided to serve as an ion source for spacecraft propulsion or plasma processing. The LGIT is composed of two stages: (1) an ionization stage composed of a hollow cathode, anode, and cusp magnetic field circuit to ionize the propellant gas; and (2) an acceleration stage composed of a downstream cathode, upstream anode, and a radial magnetic field circuit to accelerate ions created in the ionization stage. The LGIT replaces grids used in conventional ion thrusters (Kaufman guns) to accelerate ions with Hall-current electrons as in the case with conventional Hall thrusters.

9 Claims, 5 Drawing Sheets

OTHER PUBLICATIONS

Kaufman, H.R., "Technology of Closed–Drift Thrusters," AIAA Journal, vol. 23, No. 1, Jan. 1985, pp. 78–87.

King, L.B., "Transport–Property and Mass Epectral Measurements in the Plasma Exhaust Plume of a Hall–effect Space Propoulsion System," Ph.D. Thesis, University of Michigan, 1998.

Polk, J.E., et al., "An Overview of the Results from an 8200 Hour Wear Test of the NSTAR Ion Thruster," AIAA 99–2446, 35$^{th}$ Joint Propulsion Conference, Los Angeles, CA, Jun. 1999.

Schmidt, D.P., Meezan, N.B., Hargus, Jr., W.A., and Cappelli, M.A., Operating Characteristics of a Linear Hall Thruster with an Open Electron–Drift,: AIAA 99–2569, 35$^{th}$ Joint Propulsion Conference, Los Angeles, CA, Jun. 1999.

Tverdokhlebov, S.O., "Study of Double–Stage Anode Layer Thruster Using Inert Gases," IEPC Paper 93–232, 23rd International Electric Propulsion Conference, Seattle, WA, 1993.

Wilbur, P.J., Rawlin, V.K., and Beattie, J.R., "Ion Thrsuter Development Trends and Status in the United States," Journal of Propoulsion and Power, vol. 14, No. 5, Sep.–Oct., 1998.

Yamagiwa, Y., and Kuriki, K., "Performance of Double–Stage–Discharge Hall Ion Thruster," Journal of Propulsion and Power, vol. 7, No. 1, Jan.–Feb. 1991, pp. 65–70.

* cited by examiner

LINEAR GRIDLESS ION THRUSTER

FIELD OF THE INVENTION

The present invention relates to propulsion systems and, more particularly, to a linear gridless ion thruster, which combines an ionization stage from a gridded ion thruster and an acceleration stage from a closed-drift Hall thruster to take advantage of the strength of both thrusters without suffering from the weakness of either.

BACKGROUND OF THE INVENTION

The Rocket Equation (Equation 1):

$$\frac{Mf}{Mo} = \mathrm{Exp}\left(-\frac{\Delta V}{gIsp}\right) \qquad \text{Equation 1}$$

shows that the ratio of payload or final mass (Mf) over initial mass (Mo) depends on the velocity increment (ΔV) needed for a spacecraft, and the speed at which exhaust propellant leaves the propulsion system; also known as specific impulse (Isp), which is proportional to propellant exhaust velocity through the gravitational constant (g). That is, the amount of propellant needed to achieve this ΔV is reduced if the Isp of the propulsion system is increased. For example, cryogenic chemical rocket motors such as the Space Shuttle Main Engine are capable of producing specific impulses of about 450 seconds. Chemical rockets employed for long-duration space voyages must use non-cryogenic propellants that yield lower performance (<330 seconds).

Studies have shown that ideally, an engine that would be used as the primary source of propulsion for orbit transfer missions or for satellite station-keeping should produce an Isp between 1000 and 2000 seconds. Spacecraft propulsion systems for interplanetary missions may need to generate even higher exhaust velocities. To achieve the desired performance, a propulsion system must accelerate a propellant gas without relying on energy addition through chemical reactions.

One approach is the application of electrical energy to a gas stream in the form of electrical heating and/or electric and magnetic body forces. This type of propulsion is commonly known as electric propulsion (EP). EP can be categorized into three groups. Electrothermal Propulsion Systems electrically heat a gas, either with resistive elements or through the use of an electric arc, which is subsequently expanded through a nozzle to produce thrust. Electromagnetic Propulsion Systems use electromagnetic body forces to accelerate a highly ionized plasma. Electrostatic Propulsion Systems use electrostatic forces to accelerate ions. In addition to possessing suitable exhaust velocities, an EP system must be able to convert onboard spacecraft power to the directed kinetic power of the exhaust stream efficiently.

To show the benefit of EP systems over chemical systems reference is made to FIG. 1. FIG. 1 is a plot of the Rocket Equation showing the final-to-initial mass ratio for a number of missions that use conventional propulsion systems. Clearly the smaller the mass ratio, the more expensive a mission becomes. While missions to Low Earth Orbit (LEO), the moon, and Mars require significantly more propellant mass than payload mass when using chemical propulsion systems, this is not the case for EP systems due to their high Isp. This fact translates into significant cost savings for commercial, military, and scientific space missions.

FIG. 2 shows payload mass and fraction delivered to Geosynchronous Earth Orbit (GEO) as a function of trip time for EP and chemical propulsion systems assuming a moderate launch vehicle (Atlas IIAS) is used. FIG. 2 compares the performance given by a bi-propellant chemical rocket (Isp=328 sec), an arcjet using hydrazine decomposition propellant (Isp=600 sec), and a Hall thruster using xenon propellant (Isp=1600 sec). As FIG. 2 clearly shows, the amount of payload delivered to GEO increases with Isp and with trip time. The former is because the launch vehicle places a fixed spacecraft mass in LEO and as Isp increases, the amount of propellant needed for the transfer reduces. The mass that was used for propellant in the all-chemical spacecraft can now be used for payload.

A 15% increase in payload mass can be realized by simply using EP for North-South stationkeeping (NSSK) and using chemical propulsion for the LEO-to-GEO transfer. While the LEO-to-GEO trip takes longer with more of the transfer being done with EP, less propellant is required. Hence, the high-Isp EP system is used more for longer transfers, and more payload can be delivered to GEO.

This principle is being considered for the human exploration of Mars. NASA has now expressed an interest in developing the capability to send a crew to Mars within the next two decades. However, mission cost is a clear driver. Since the LEO-to-MTO (Mars Transfer Orbit) ΔV is a significant fraction of the total mission ΔV, and hence accounts for much of LEO initial vehicle mass, NASA has baselined the use of a Solar Electric Propulsion (SEP) stage to raise a chemically-powered Mars Transfer (MT) stage to a highly elliptic orbit around the Earth. Once the MT stage is in the proper orbit, the crew uses a small, chemically-propelled vehicle to rendezvous with it. Once the crew is in place and the MT stage has been certified to be fully operational, it separates from the SEP stage and ignites its engines for the trip to Mars.

EP's resurgence in recent years is due both to the public's interest in space exploration and money that be saved by commercial spacecraft developers. As illustrated above, the latter comes by virtue of the fact that EP's large specific impulse means that it can accomplish a mission with less propellant than conventional propulsion systems. The recent successes of the Deep Space-1 and Mars Pathfinder missions have helped to renew the public's excitement about space exploration.

The Mars mission scenario described above reduces both trip time (for the crew) and initial spacecraft mass by utilizing a high-performance SEP stage. The key to developing the SEP stage is the utilization of an engine that posses high specific impulse, high thrust efficiency, and a large range of specific impulse over which it can operate while maintaining high efficiency.

At first glance, a gridded ion engine appears to be ideal for the above application. Ion thrusters have very high specific impulses and efficiencies, and have a moderately large range of specific impulses over which they can operate at better than 50% efficiency. However, since such an engine will need to process hundreds of thousands or millions of watts of power, conventional gridded-ion thrusters are inappropriate given the size requirement such an engine would have due to its space-charge and grid erosion limitations.

On the other hand, conventional single-stage Hall thrusters possess high engine efficiency at moderately-high specific impulses. However, the ability to operate single-stage Hall thrusters with long life at very high specific impulses has never been demonstrated nor can ionization processes be decoupled from acceleration processes. The latter results in the strong interdependence of discharge current, discharge voltage, and propellant flow rate that limits the operational flexibility of these engines.

Furthermore, since ions are created at various spots along the ionization/acceleration region, not all ions benefit from the full accelerating potential of the discharge, resulting in a loss of engine efficiency. Moreover, the effect on engine life of placing 1000–2000 V discharge voltages on single stage Hall thrusters (e.g., on the anode from back-streaming electrons) is unknown. Lastly, for specific impulses of ~1300 seconds or less, conventional Hall thruster efficiencies are low because of the coupled ionization and acceleration zones. This would serve to limit the "throttling" capability of the SEP stage (e.g., to provide "high" thrust at moderate specific impulse for certain phases of its orbital burn).

The desire for high throttling performance (also known as "Dual Mode Operation") applies to a number of commercial, military, and scientific missions. For commercial and military satellites, for example, the high-thrust, lower-Isp mode would be used for LEO-to-GEO transfer while the lower-thrust, high-Isp mode would be used for station-keeping.

In single-stage Hall thrusters, shown schematically in FIG. 3, ions are accelerated by the electric field established between a downstream cathode and an upstream anode. An applied radial magnetic field in an annular discharge chamber impedes the motion of migrating electrons. The crossed electric and magnetic fields create an azimuthal closed electron drift; the Hall current.

Propellant is injected at the anode and collisions in the closed drift region create ions. The ionization and acceleration processes in such a configuration are closely linked, limiting the useful operating range of the thruster to around 2500 s specific impulse and <~60% efficiency. Operation below these values results in intolerable decay in thruster efficiencies (<35% efficiency around 1200 s specific impulse). This prevents Dual Mode Operation from becoming a reality.

Ionization and acceleration can be made more independent by the introduction of an intermediate electrode in the channel; a two-stage Hall thruster. FIG. 4 is a schematic of a traditional two-stage Hall thruster. The intermediate electrode acts as the cathode for the ionization stage and the anode for the acceleration stage. This allows the ionization stage to operate at high currents and low voltages resulting in higher propellant utilization (the efficiency at which propellant atoms are converted to thrust-producing beam ions) and the acceleration stage to operate at variable voltages resulting in a wide specific impulse range of operation.

Overall thruster efficiency is enhanced in this configuration, as Equation 2 illustrates:

$$\eta_t = \frac{1}{1 + I_d V_d / I_a V_a} \qquad \text{Equation 2}$$

where $\eta_t$ is the overall efficiency, I is current, V is voltage, and the subscripts 'a' and 'd' refer to the acceleration and discharge (ionization) stages, respectively. Thus, efficiency is increased for low discharge voltages and high acceleration voltages.

Work by Tverdokhlebov on a two-stage anode layer thruster demonstrated high efficiency (>67%) at high acceleration voltages (>500 V), but was unable to lower the discharge voltage below 50 V because backstreaming electrons were not of sufficient energy to maintain the discharge. Therefore, in such a configuration the ionization and acceleration processes are still weakly coupled due to the dependence of the discharge on backstreaming electrons. Further, operation of such a thruster has not yet been shown to be efficient at powers less than 6 kW and below 2500 s specific impulse. It is clear that a configuration that does not depend on backstreaming electrons is warranted so that discharge voltages may be minimized and ion production costs lowered.

Researchers in Japan have shown that use of an emitting intermediate electrode significantly increased the efficiency of a two-stage Hall thruster. These results are shown in FIGS. 5*a* and 5*b*. The two-stage device with cathode heating outperformed its single- and double-stage (no cathode heating) operation. Note that the efficiency of this device is very low, but this is believed to be caused by poor design owing to a long channel length and not to any physical constraints.

The trends demonstrated in FIG. 5 may indicate that an emitting intermediate electrode will increase overall efficiency. However, neither the Japanese work referenced here or any previous work known to the inventors have used magnetic fields expressly designed for the purpose of enhancing ionization; a technique commonly used in ion engines with great success.

As the following discussion will show, a gridless ion thruster that utilizes the ionization efficiency of a gridded ion thruster with the acceleration processes of a Hall thruster appears to be ideal for the application described above.

SUMMARY OF THE INVENTION

The present invention is directed towards a linear gridless ion thruster (LGIT) for use as an ion source that can be used for spacecraft propulsion or plasma processing. The LGIT is composed of two stages: (1) an ionization stage composed of a hollow cathode, anode, and cusp magnetic field circuit to ionize the propellant gas; and (2) an acceleration stage composed of a downstream cathode, upstream anode, and a radial magnetic field circuit to accelerate ions created in the ionization stage. The LGIT replaces grids used in conventional ion thrusters (Kaufman guns) to accelerate ions with Hall-current electrons as is the case with conventional Hall thrusters.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIGS. 5*a* and 5*b* are graphs illustrating data from a Japanese Hall thruster using an emitting intermediate electrode (cathode heating), wherein FIG. 5*a* illustrates ion production cost versus propellant utilization, and FIG. 5*b* illustrates total efficiency or thrust versus specific impulse (the double stage thruster with cathode heating has the best performance in both figures);

DETAILED DESCRIPTION OF THE PREFERRED EMBODIMENTS

The following description of the preferred embodiment is merely exemplary in nature and is in no way intended to limit the invention, its application, or uses.

Figure 1:
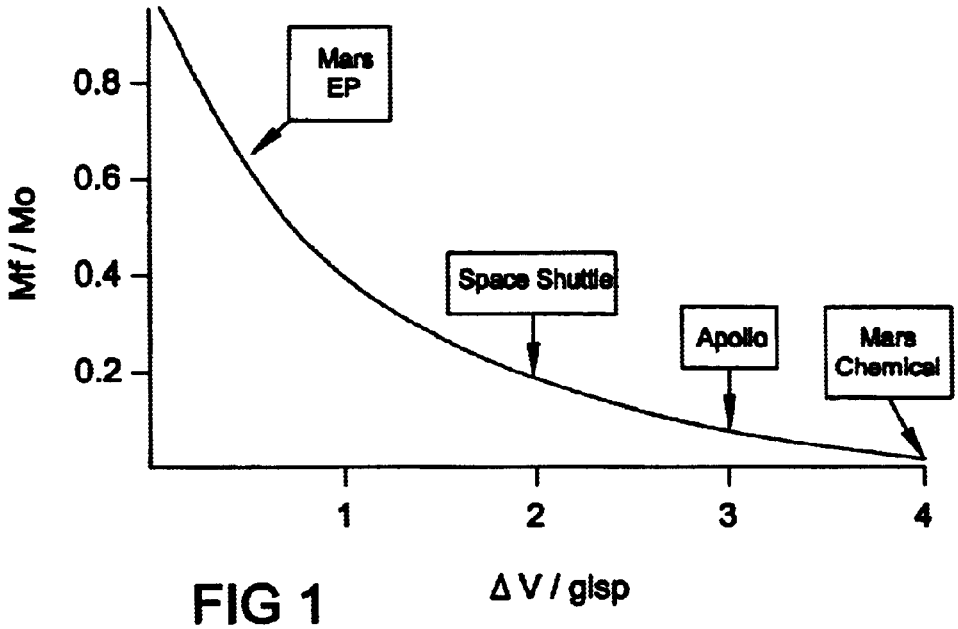
FIG 1 Prior Art
FIG. 1 is a graph illustrating the ratio of Payload Mass to Initial Mass for a one-way mission to Mars (EP and Chemical Propulsion), a Space Shuttle Mission to Low Earth Orbit, and an Apollo Moon Mission.
Figure 2:
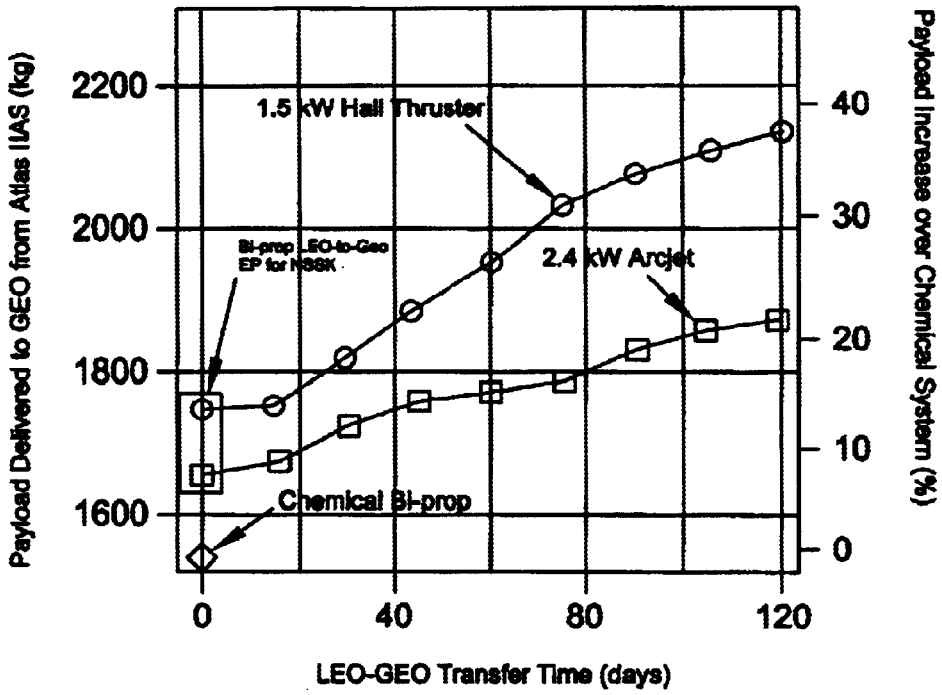
FIG 2 Prior Art
FIG. 2 is a graph illustrating payload delivered to Geosynchronous Earth Orbit (GEO) as a function of trip time for EP and chemical propulsion systems.
Figure 3:
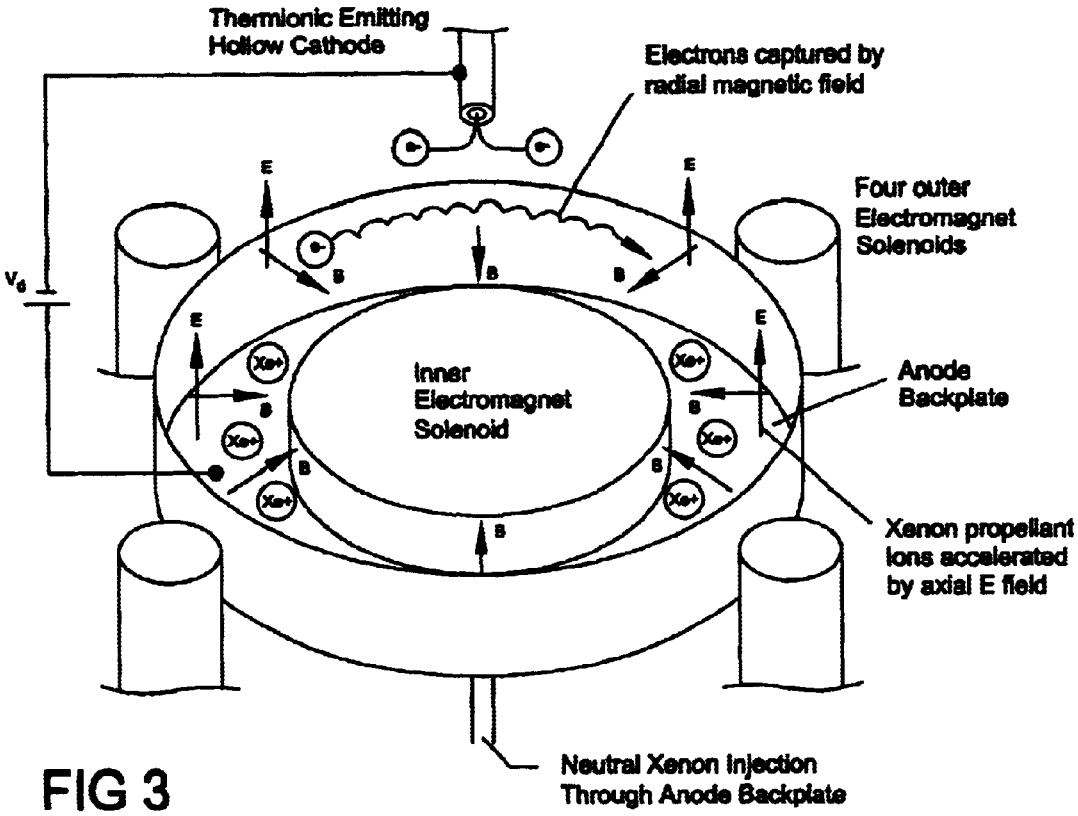
FIG 3 Prior Art
FIG. 3 is a perspective view of conventional Hall thruster components showing the potential drop between the cathode and anode, magnetic field circuitry, and the closed electron drift induced by the crossed electric and magnetic fields.
Figure 4:
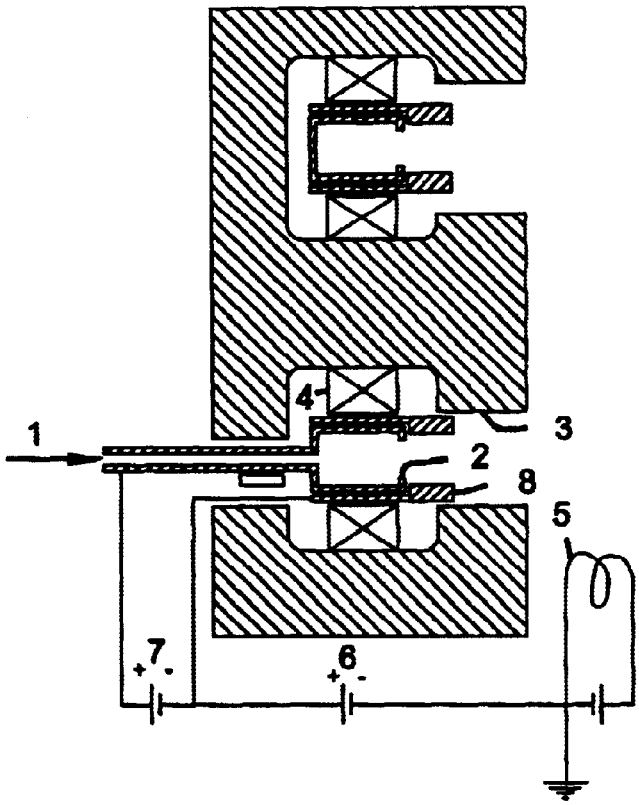
FIG 4 Prior Art
FIG. 4 is a cross-sectional view of a conventional two-stage Hall thruster (with anode layer) with Propellant feed 1, anode 2, magnetic circuit 3, magnet winding 4, cathode neutralizer 5, acceleration stage potential 6, ionization stage potential 7, and intermediate electrode 8.
Figure 5A:
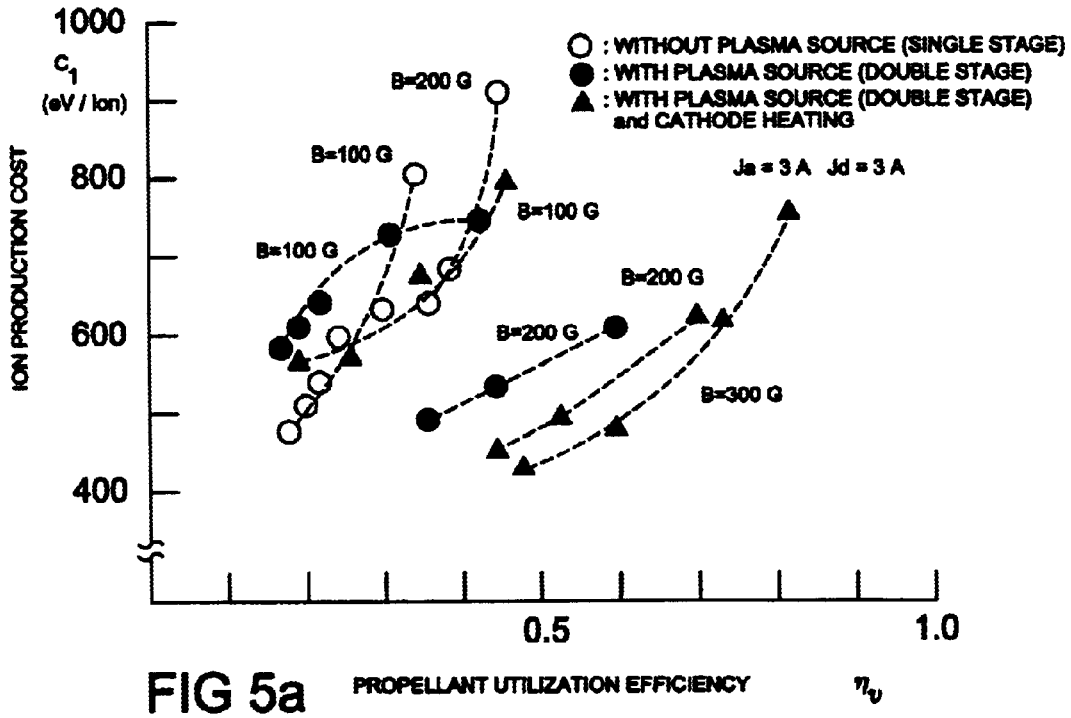
FIG 5a Prior Art
Figure 5B:
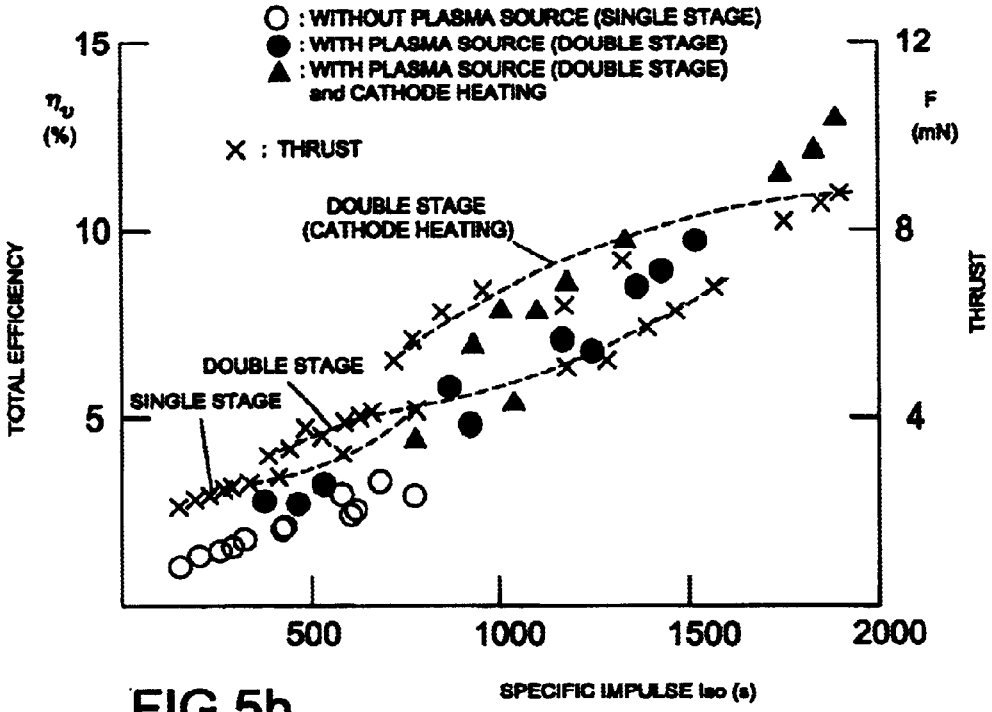
FIG 5b Prior Art
Figure 6:
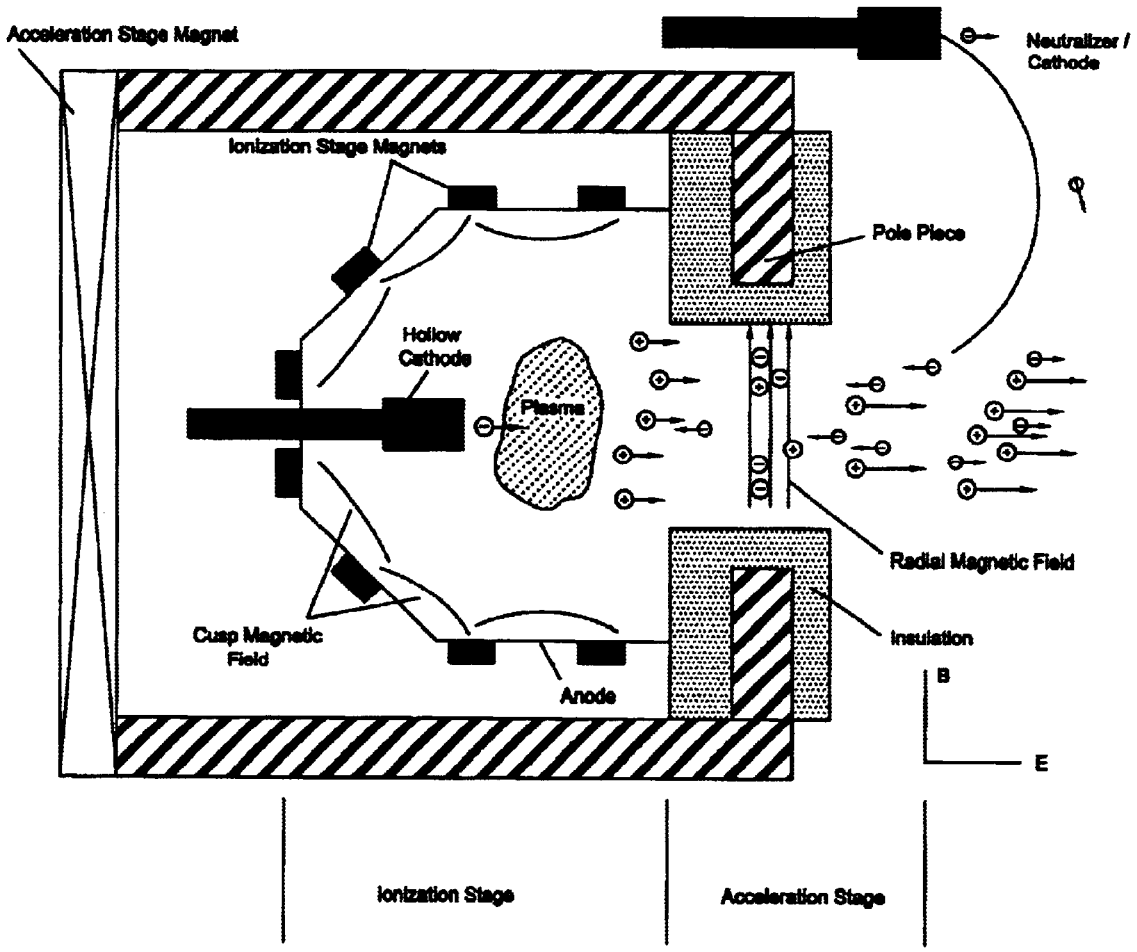
FIG. 6 is a cross-sectional view of a two-stage Linear Gridless Ion Thruster incorporating the teachings of the present invention.
Figure 7:
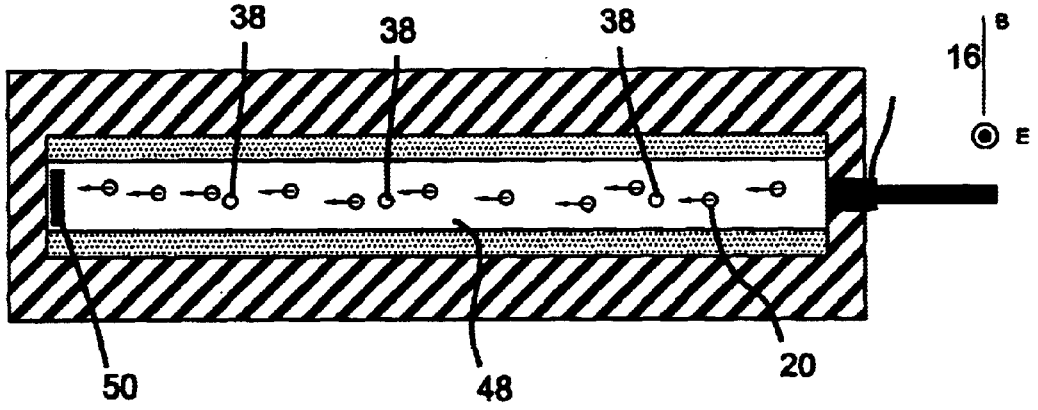
FIG. 7 is a front elevational view of the two-stage Linear Gridless Ion Thruster of FIG. 6.

FIGS. 6 and 7 show the basic configuration for the Linear Gridless Ion Thruster (LGIT) 10 of the present invention. The LGIT 10 combines the ionization processes of an ion thruster with the acceleration process of a closed-drift Hall thruster. The LGIT 10 operates as follows.

Ionization Stage: Neutrals 12 are first injected into an interior volume of an ionization stage linear discharge chamber 14 through a hollow cathode 16 and through a secondary injection port 18. The hollow cathode 16 is preferably a barium-oxide impregnated porous tungsten hollow cathode.

Electrons 20 emitted from the hollow cathode 16 and accelerated through the cathode-to-anode discharge voltage created in the chamber 14 ionize the neutrals 12. This configuration of the discharge chamber 14 is similar to that found in ring-cusp gridded ion thrusters in that permanent magnets 24 are placed on the anode 26 of the chamber 14 (which is downstream of the cathode 16) to create magnetic field cusps 28.

The cusps 28 limit the migration of electrons 20 and ions 30 to the walls 32 of the discharge chamber 14 where they would be lost through recombination. This is done by magnetizing the electrons 20, thereby slowing cross-field diffusion, and establishing a magnetic mirror that reflects the ions 30 back towards the center of the discharge chamber 14.

Magnetizing the electrons 20 also means that their effective cathode-to-anode path length is greatly increased over the cathode-to-anode geometric length. This greatly increases the electron-neutral collision probability and accounts for the efficiency at which ions 30 are created. Discharge chamber voltages for ring-cusp ion thrusters are typically below 30 V. The corresponding number for two-stage Hall thrusters is typically 75 V although 50 V has been achieved as mentioned above.

Once the ions 30 are created, they diffuse towards the exit 34 of the discharge chamber 14 by the electric field established by the cathode-anode combination, and the electrons 20 within the acceleration stage gap 36.

Acceleration Stage: The electrons 20 emitted from at least one other hollow cathode 38 positioned downstream and towards the side of the LGIT 10 (see FIG. 7) are attracted axially upstream towards the discharge chamber anode 26 by an axial electric field. However, the perpendicularly directed radial magnetic field 40 established by the magnet 42 (electro or permanent) at one end of the chamber 14 and pole piece 44 (covered with insulation 46) at the opposite end of the chamber 14 impedes the axial progress of the electrons 20 and causes them to flow in the E×B direction; i.e., across the front of the LGIT 10 along the channel 48 as shown in FIG. 7. It is this flow of electrons 20 that establishes the axial electric field that accelerates the ions 30. It should be noted that the magnetic field 40 is set so only the electrons 20 are magnetized, as in the case of a closed-drift Hall thruster.

Electrons 20 that travel parallel with the front of the LGIT 10 (i.e., in the E×B direction) are captured either by the discharge chamber anode 26 or by an optional auxiliary electrode 50 (FIG. 7) to the side of the gap 36. Since electrons 20 and ions 30 are present in the acceleration gap 36, the ion beam 52 is not space-charge-limited as is the case for gridded ion thrusters, which limits axial ion thruster beam currents to less than 20 mA/cm$^2$. This means that the LGIT 10 can accelerate a much higher beam current over a given area.

For example, an ion thruster based on the NSTAR design that could process 5 A of beam current at 1100 V would need an acceleration passage area (i.e., total open area of the grid) of at least 280 cm$^2$ or an effective beam diameter of 19 cm. However, when one takes into account the needed webbing of the grid, the actual grid diameter increases considerably. Moreover, the design beam current for flight gridded ion thrusters is also dictated by grid erosion considerations and will be much less than the space-charge limit.

For example, the NSTAR thruster flown on DS-1 had a grid diameter of 30 cm and a maximum beam current of 1.76 A. In comparison, a closed-drift Hall thruster can process a beam current of 8 A over a gap area of 110 cm$^2$. It is predicted that the LGIT 10 will have beam current densities commensurate with closed-drift Hall thrusters. This has, in fact, been demonstrated with a low-power single-stage linear Hall thruster that processed a beam current density of over 700 mA/cm$^2$.

Although other configurations are available, it is presently preferred to form the discharge chamber 14 with a 16 mm height and a 144 mm width. The depth of the acceleration zone is preferably about 18 mm. Since the plasma is produced in the discharge chamber 14 and not the acceleration stage, it is believed that the acceleration zone can be shortened to reduce wall losses. The ionization zone is sized to insure that a neutral xenon atom injected into it will have a high probability of being ionized before escaping into the acceleration zone due to thermal motion. A length of 50 mm has been determined to provided adequate margin in terms of ionization time.

Figure 8:
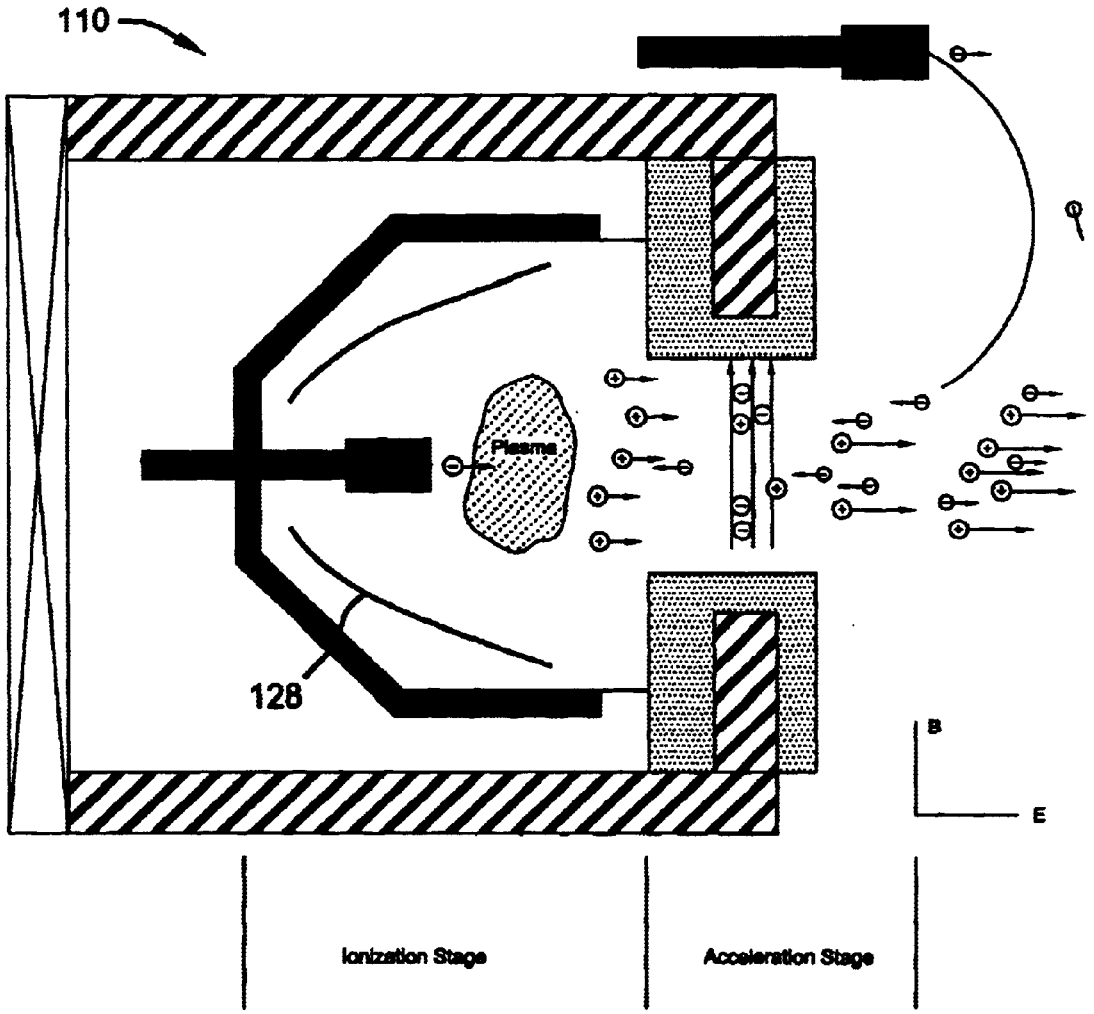
FIG. 8 is a cross-sectional view of an alternate embodiment two-stage Linear Gridless Ion Thruster incorporating the teachings of the present invention.

Turning now to FIG. 8, an alternate embodiment LGIT 110 is illustrated. In this embodiment, the ring cusp 28 of the first embodiment is replaced with a line cusp 128. This embodiment is preferred when ease of manufacture is desirable. A ring cusp configuration may produce asymmetry in the discharge due to mixing effects where the cusp fields of the ionization zone meet the transverse fields of the acceleration region. The line-cusp configuration could be arranged to provide symmetric field lines.

While single-stage linear Hall thruster configurations have been developed in the past, they have never been employed in conjunction with an ionization stage. This is one design feature of the LGIT 10 of the present invention. The combination of an ionization stage from a gridded ion thruster and the acceleration stage from closed-drift Hall thrusters means that the LGIT 10 takes advantage of the strengths of both thrusters but does not suffer from the weakness of either.

Ions are efficiently created in an ionization stage that is decoupled from the acceleration process—as is the case for a gridded ion thruster—and then accelerated in a gap that is not space-charge limited. Single-stage linear Hall thrusters suffer from the fact that electrons emitted from the neutralizer cathode are expected to ionize the propellant as well as establish the acceleration electric field.

While this is possible with closed-drift Hall thrusters since discharge chamber electrons travel around the annular discharge chamber hundreds of times before they are absorbed by the anode, linear Hall thruster electrons make only one pass. This means that for a similar discharge chamber exit area, closed-drift electrons will be hundreds of times more efficient at ionizing propellant particles than linear thruster electrons. This problem is avoided by the LGIT 10 since electrons emitted by the neutralizer cathode would not be required to ionize propellant.

Since the combined operation of single- and double-stage Hall thrusters have been shown to span 1000–4300 s specific impulse at 35–75% efficiency, similar performance can be expected for the LGIT 10 but with greatly improved low-Isp efficiency. Moreover, since a linear discharge chamber gap is employed, it should be possible to design a magnetic circuit that minimizes plume divergence. Modulation of the magnetic field along the span of the thruster may provide thrust-vector control without the need of a gimbal. That is, in the acceleration zone, the magnetic field is perpendicular to the flow. This magnetic field is controlled by electromagnets placed near the LGIT exit plane. By varying the relative strength of the top and bottom electromagnets, the shape of the magnetic field near the exit will vary thereby allowing two-dimensional thrust vectoring of the ion beam.

In addition to propulsion applications, the LGIT 10 can be used for industrial applications such as plasma processing and plasma spraying. The innovative aspects that make LGIT 10 promising for space propulsion will likewise apply to industrial applications.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ion thruster comprising:

an ionization stage including:

a first cathode;

an anode associated with the first cathode; and a first magnetic field circuit ionizing propellant gas, said first magnetic field circuit comprising at least one magnet disposed alone said anode and a cusp magnetic field; and an acceleration stage downstream of the ionization stage, the acceleration stage including:

a second cathode downstream of the anode; and a second magnetic field circuit accelerating ions created in the ionization stage.

2. The ion thruster of claim 1 wherein the acceleration stage is disposed axially downstream of said ionization stage.

3. The ion thruster of claim 1 wherein the first cathode further comprises a hollow cathode.

4. The ion thruster of claim 1 wherein said at least one magnet further comprises a plurality of magnets and said cusp magnetic field further comprises a ring cusp magnetic field.

5. The ion thruster of claim 1 wherein said cusp magnetic field further comprises a line cusp magnetic field.

6. The ion thruster of claim 1 wherein the second cathode further comprises a hollow cathode disposed adjacent an exit of the ionization stage.

7. The ion thruster of claim 1 wherein the second magnetic field circuit further comprises at least one magnet and a magnetic field oriented perpendicular to a flow of the ionized propellant gas.

8. An ion thruster comprising:

an ionization stage including:

linear discharge chamber;

a first hollow cathode having an open end disposed in the discharge chamber;

an anode disposed in the discharge chamber downstream of the first cathode; and at least one magnet on the anode creating magnetic field cusps in the discharge chamber;

an acceleration stage disposed axially downstream of the ionization stage, the acceleration stage including:

an acceleration stage gap at an exit of the discharge chamber downstream of the anode;

a second hollow cathode positioned downstream and towards a side of the acceleration stage gap;

pole pieces positioned adjacent the acceleration gap; and a magnet coupled to the pole pieces creating a transverse magnetic field coupled to the exit of the discharge chamber.

9. The thruster of claim 8 further comprising an auxiliary electrode opposite the second hollow cathode.

* * * * *

UNITED STATES PATENT AND TRADEMARK OFFICE

CERTIFICATE OF CORRECTION

PATENT NO. : 6,640,535 B2
DATED : November 4, 2003
INVENTOR(S) : Gallimore et al.

It is certified that error appears in the above-identified patent and that said Letters Patent is hereby corrected as shown below:

Column 8,
Line 3, “alone” should be -- along --.

Signed and Sealed this

Eleventh Day of May, 2004

JON W. DUDAS
*Acting Director of the United States Patent and Trademark Office*